US010577884B2

(12) United States Patent
Trivedi et al.

(10) Patent No.: US 10,577,884 B2
(45) Date of Patent: Mar. 3, 2020

(54) BLOWOUT PREVENTION SYSTEM INCLUDING BLIND SHEAR RAM

(71) Applicant: GENERAL ELECTRIC COMPANY, Schenectady, NY (US)

(72) Inventors: Deepak Trivedi, Halfmoon, NY (US); Kevin James Shufon, Troy, NY (US); Walter John Smith, Ballston Spa, NY (US); Charles Erklin Seeley, Niskayuna, NY (US); Brian Scott Baker, Houston, TX (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/476,422

(22) Filed: Mar. 31, 2017

(65) Prior Publication Data

US 2018/0283128 A1 Oct. 4, 2018

(51) Int. Cl.
*E21B 33/06* (2006.01)

(52) U.S. Cl.
CPC ..... *E21B 33/063* (2013.01)

(58) Field of Classification Search
USPC ..... 251/1.1–1.3
See application file for complete search history.

(56) References Cited

U.S. PATENT DOCUMENTS 3,817,326 A 6/1974 Meynier, III
4,580,626 A 4/1986 Jones
4,646,825 A 3/1987 Van Winkle
6,244,336 B1 6/2001 Kachich
6,397,948 B1 6/2002 Williams et al.
7,234,530 B2 6/2007 Gass et al.
7,367,396 B2 * 5/2008 Springett ..... E21B 33/063 166/298
7,810,553 B2 10/2010 Cruickshank et al.
8,387,706 B2 3/2013 Baugh
8,448,915 B2 5/2013 Baugh et al.
8,720,565 B2 5/2014 Springett et al.
(Continued)

FOREIGN PATENT DOCUMENTS

AU 2012211431 B2 4/2014
WO 2017/040198 A1 3/2017

OTHER PUBLICATIONS

Palmer, R., et al., "Developments in Coiled Tubing BOP Ram Design," Offshore Technology Conference, pp. 1-7 (1995).
(Continued)

*Primary Examiner* — Jessica Cahill
*Assistant Examiner* — Daphne M Barry
(74) *Attorney, Agent, or Firm* — Laura L. Pollander

(57) ABSTRACT

A blind shear ram includes an upper carrier including an upper blade and a lower carrier including a lower blade. The upper carrier and the lower carrier are positionable in a first position in which the upper carrier and the lower carrier are spaced apart and a second position in which the upper carrier and the lower carrier seal a wellbore. The upper blade and the lower blade are configured to cut at least one pipe and at least one cable when the upper carrier and the lower carrier move between the first position and the second position. At least one of the upper blade and the lower blade includes a textured surface configured to induce friction between the at least one cable and the blade.

20 Claims, 4 Drawing Sheets

(56) References Cited

U.S. PATENT DOCUMENTS

| | | | | |
|---|---|---|---|---|
| 9,022,104 | B2 | 5/2015 | Springett et al. | |
| 9,593,550 | B1 * | 3/2017 | Jennings | E21B 33/063 |
| 2004/0003919 | A1 | 1/2004 | Johnson et al. | |
| 2012/0067563 | A1 | 3/2012 | Jellison | |
| 2013/0153204 | A1 | 6/2013 | Carbaugh et al. | |
| 2014/0048245 | A1 | 2/2014 | Yendell et al. | |
| 2014/0110611 | A1 | 4/2014 | McClanahan et al. | |

OTHER PUBLICATIONS

"Q-Guide™ Shear and Seal Wireline Ram Assembly," Elmar, National Oilwell Varco, p. 1 (2014).

Schlegelmilch, T., "The design of a coiled tubing cutter for use in subsea oil drilling applications," Massachusetts Institute of Technology, pp. 1-85 (1999).

International Search Report and Written Opinion issued in connection with corresponding PCT Application No. PCT/US2018/018134 dated May 29, 2018.

* cited by examiner

BLOWOUT PREVENTION SYSTEM INCLUDING BLIND SHEAR RAM

BACKGROUND

The field of the disclosure relates generally to a blowout prevention (BOP) system for oil and gas wells, and more particularly to a BOP system including a blind shear ram.

Many known oil and gas production systems include a blowout prevention (BOP) system that seals a wellbore to inhibit release of materials through the wellbore. At least some known BOP systems include blind shear rams including blades. During operation, the blind shear rams cut a pipe extending through the wellbore and seal the wellbore. However, at least some known blind shear rams do not completely cut objects such as cables that extend through the wellbore along the pipe. As a result, the uncut cables inhibit the blind shear ram sealing the wellbore.

BRIEF DESCRIPTION

In one aspect, a blind shear ram for a blowout prevention system is provided. The blind shear ram includes a casing configured to couple to a stack and receive at least one pipe and at least one cable. The at least one pipe and the at least one cable extend through a wellbore defined by the stack. The blind shear ram also includes an upper carrier including an upper blade and a lower carrier including a lower blade. At least one of the upper carrier and the lower carrier is configured to move relative to the casing such that the upper carrier and the lower carrier are positionable in a first position in which the upper carrier and the lower carrier are spaced apart and a second position in which the upper carrier and the lower carrier seal the wellbore. The upper blade and the lower blade are configured to cut the at least one pipe and the at least one cable when the upper carrier and the lower carrier move between the first position and the second position. At least one of the upper blade and the lower blade includes a textured surface configured to induce friction between the at least one cable and the at least one of the upper blade and the lower blade.

In another aspect, a blowout prevention system is provided. The blowout prevention system includes a stack defining a wellbore and a blind shear ram configured to couple to the stack and receive at least one pipe and at least one cable extending through the wellbore. The blind shear includes an upper carrier including an upper blade and a lower carrier including a lower blade. At least one of the upper carrier and the lower carrier is configured to move relative to the casing such that the upper carrier and the lower carrier are positionable in a first position in which the upper carrier and the lower carrier are spaced apart and a second position in which the upper carrier and the lower carrier seal the wellbore. The upper blade and the lower blade are configured to cut the at least one pipe and the at least one cable when the upper carrier and the lower carrier move between the first position and the second position. At least one of the upper blade and the lower blade includes a textured surface configured to induce friction between the at least one cable and the at least one of the upper blade and the lower blade.

In still another aspect, a method of assembling a blind shear ram for a blowout prevention system is provided. The method includes providing at least one blade configured to cut a cable in a wellbore. The at least one blade includes a cutting edge, a rear edge opposite the cutting edge, and at least one surface extending from the rear edge to the cutting edge. The method also includes texturing the at least one surface of the at least one blade to form at least one textured surface. The at least one textured surface is configured to induce friction between the cable and the at least one blade. The method further includes coupling the at least one blade to at least one of a lower carrier and an upper carrier such that the at least one textured surface is configured to contact the cable. At least one of the upper carrier and the lower carrier is configured to move relative to the casing such that the upper carrier and the lower carrier are positionable in a first position in which the upper carrier and the lower carrier are spaced apart and a second position in which the upper carrier and the lower carrier seal the wellbore.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "texture" refers to surface variations in the normal direction from a smooth surface. The term "stiction" refers to a force that prevents movement of an object.

The methods and systems described herein facilitate cutting cables in a wellbore to provide a more complete seal of the wellbore. For example, embodiments of the blowout prevention (BOP) system include a blind shear ram including blades including at least one textured surface. In some embodiments, abrasions are formed in the textured surface using mechanical and/or chemical processes. In further embodiments, the textured surface includes a pattern. The textured surface grips the cables to facilitate the blades completely severing the cables. As a result, the cables are inhibited from extending across the seal when the blind shear ram seals the wellbore.

Figure 1:
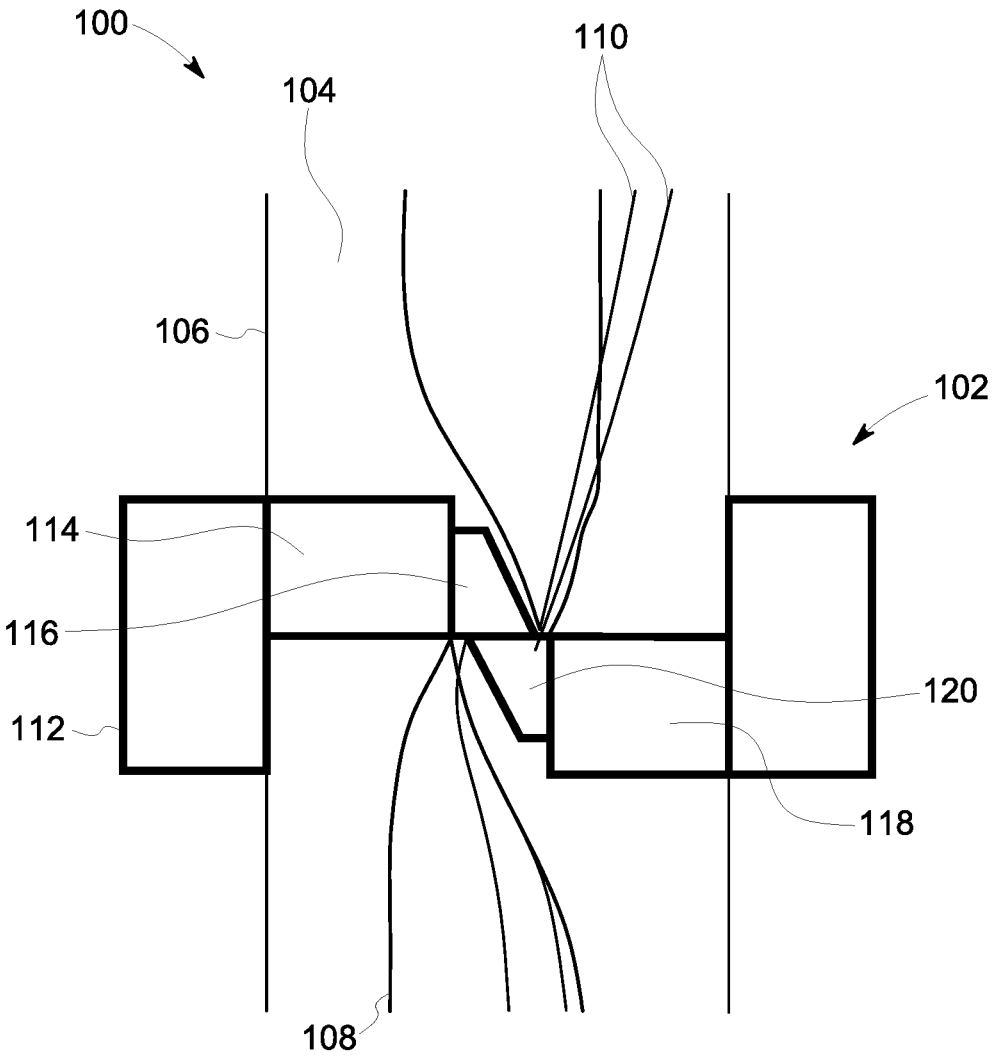
FIG. 1 is a schematic view of an exemplary blowout prevention (BOP) system including a blind shear ram.

FIG. 1 is a schematic view of an exemplary blowout prevention (BOP) system 100 including a blind shear ram 102. BOP system 100 is configured to seal a wellbore 104 at least partially defined by a stack 106 and inhibit material flowing through wellbore 104. In particular, blind shear ram 102 is configured to cut a pipe 108 and cables 110 extending through wellbore 104 and seal wellbore 104. In alternative embodiments, BOP system 100 has any configuration that enables BOP system 100 to operate as described herein. For example, in some embodiments, BOP system 100 includes a shear ram and/or an annular blowout preventer.

Figure 2:
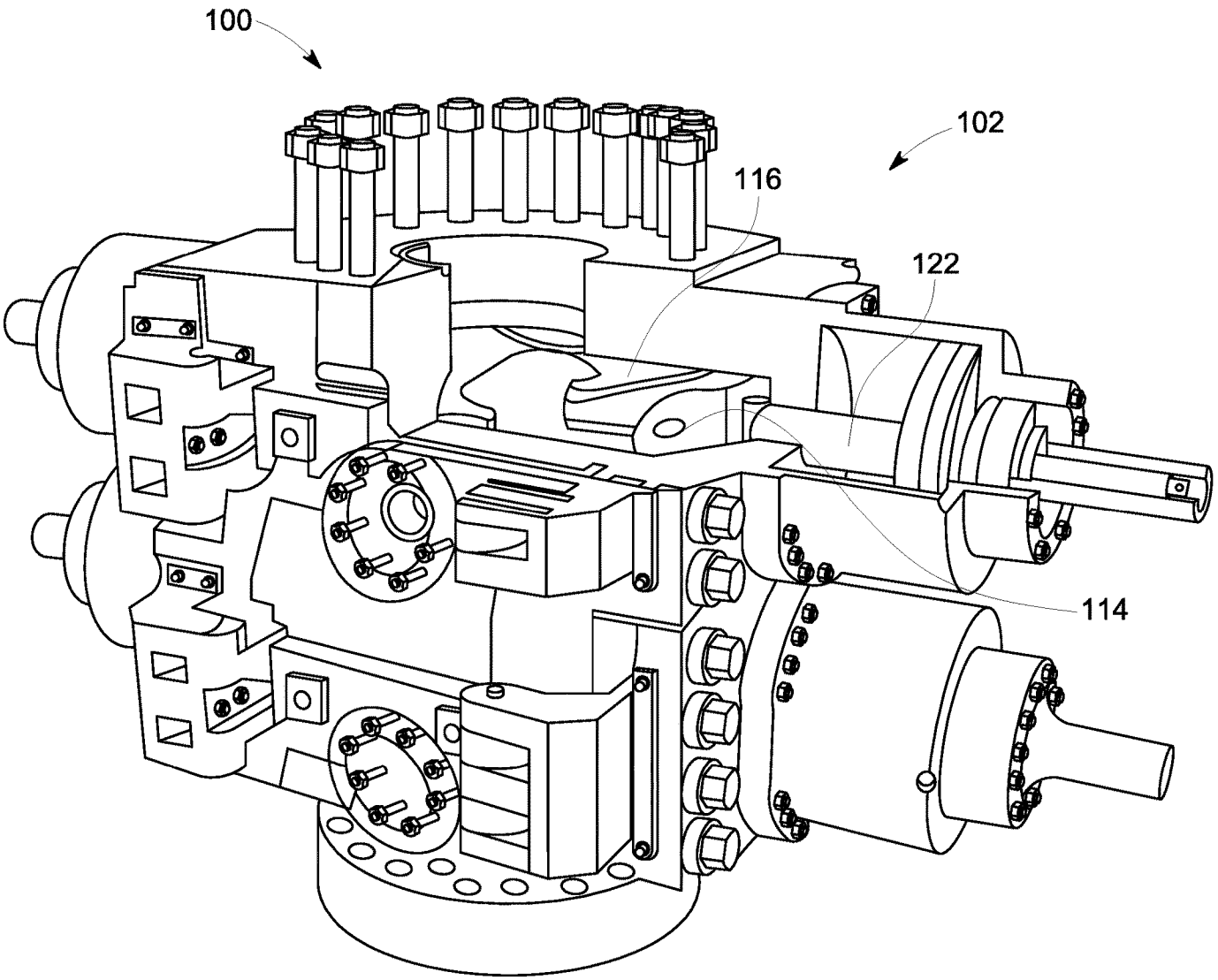
FIG. 2 is a perspective view of the BOP system shown in FIG. 1.
Figure 3:
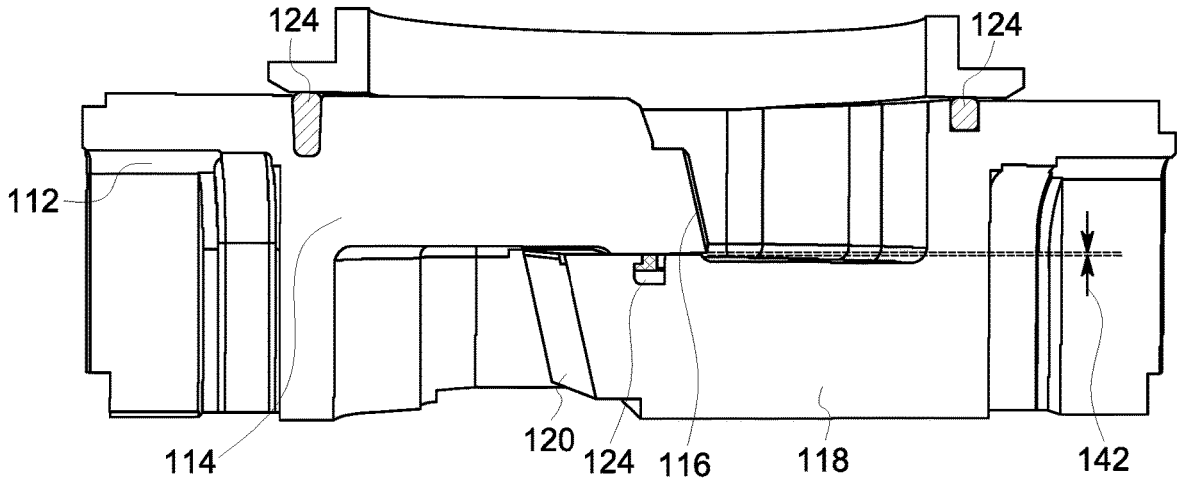
FIG. 3 is a sectional view of the blind shear ram shown in FIGS. 1 and 2.

FIG. 2 is a perspective view of BOP system 100 including blind shear ram 102. FIG. 3 is a sectional view of blind shear ram 102. Blind shear ram 102 includes a casing 112, an upper carrier 114, an upper blade 116, a lower carrier 118, a lower blade 120, and at least one ram actuator 122. In the exemplary embodiment, ram actuators 122 are coupled to each of upper carrier 114 and lower carrier 118. Ram actuators 122 are configured to move upper carrier 114 and lower carrier 118 relative to casing 112 such that upper carrier 114 and lower carrier 118 are positionable in a first position and a second position. In the exemplary embodiment, ram actuators 122 are hydraulic. In alternative embodiments, blind shear ram 102 includes any ram actuator 122 that enables blind shear ram 102 to operate as described herein.

In reference to FIG. 1, casing 112 is configured to couple to stack 106 and receive pipe 108 and cables 110. When upper carrier 114 and lower carrier 118 are in the first position, upper carrier 114 and lower carrier 118 are spaced apart on opposite sides of casing 112 such that pipe 108 and cables 110 pass between upper carrier 114 and lower carrier 118. As upper carrier 114 and lower carrier 118 move from the first position to the second position, upper carrier 114 and lower carrier 118 move towards each other and compress pipe 108 and cables 110. Upper blade 116 and lower blade 120 are configured to contact and cut pipe 108 and cables 110 as upper carrier 114 and lower carrier 118 move from the first position to the second position. In the second position, upper carrier 114 and lower carrier 118 seal wellbore 104. In the exemplary embodiment, at least one seal 124 (shown in FIG. 3) extends between upper carrier 114 and lower carrier 118 to facilitate sealing wellbore 104 when upper carrier 114 and lower carrier 118 are in the second position. In alternative embodiments, wellbore 104 is sealed in any manner that enables BOP system 100 to operate as described herein.

Figure 4:
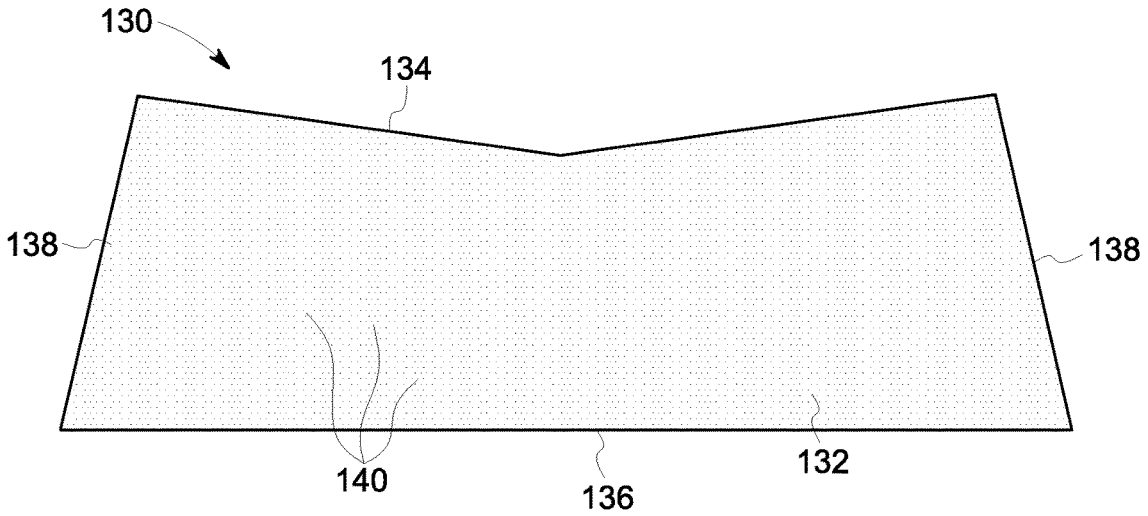
FIG. 4 is a plan view of a blade for use with the blind shear ram shown in FIGS. 1-3.

FIG. 4 is a plan view of a blade 130 for use with blind shear ram 102 (shown in FIGS. 1 and 3). In some embodiments, blade 130 is used as upper blade 116 (shown in FIG. 3) and/or lower blade 120 (shown in FIG. 3). Blade 130 includes a textured surface 132. Textured surface 132 is configured to contact cables 110 (shown in FIG. 1) and increase friction between cables 110 and blade 130. In particular, in the exemplary embodiment, textured surface 132 increases stiction between cables 110 and blade 130 and causes textured surface 132 to grip portions of cables 110 such that the portions of cables 110 remain stationary relative to blade 130. As a result, blade 130 creates local tension zones in cables 110 which lead to severing of cables 110. Accordingly, textured surface 132 facilitates blade 130 cutting cables 110. In alternative embodiments, blade 130 includes any surface that enables blade 130 to operate as described herein. For example, in some embodiments, blade 130 includes a first textured surface 132 forming at least a portion of a top surface and a second textured surface 132 forming at least a portion of a bottom surface.

In the exemplary embodiment, blade 130 further includes a cutting edge 134, a rear edge 136, and side edges 138. Rear edge 136 is opposite cutting edge 134. Side edges 138 extend between rear edge 136 and cutting edge 134. Cutting edge 134 is sharpened to facilitate blade 130 cutting objects. In alternative embodiments, blade 130 includes any edge that enables blade 130 to operate as described herein.

Also, in the exemplary embodiment, textured surface 132 extends throughout blade 130. Specifically, textured surface 132 extends from cutting edge 134 to rear edge 136 and from first side edge 138 to second side edge 138. Accordingly, textured surface 132 is configured to contact cables 110 (shown in FIG. 1) throughout blade 130 and allows blade 130 to cut cables 110 that are positioned anywhere in wellbore 104. In addition, the friction force between blade 130 and cables 110 (shown in FIG. 1) is increased because textured surface 132 extends throughout blade 130. In alternative embodiments, textured surface 132 extends through any portions of blade 130 that enable blade 130 to operate as described herein.

In addition, in the exemplary embodiment, blade 130 is a generally concave pentagon. In particular, rear edge 136 is substantially linear and side edges 138 are angled relative to rear edge 136. Cutting edge 134 includes a divot or V-shape and is angled relative to rear edge 136. Accordingly, cutting edge 134 directs objects toward a middle of blade 130 during cutting and inhibits objects moving around blade 130. In alternative embodiments, blade 130 has any shape that enables blade 130 to operate as described herein. For example, in some embodiments, blade 130 is, without limitation, rectangular, square, curved, trapezoidal, triangular, and/or any other suitable shape.

Moreover, in the exemplary embodiment, textured surface 132 includes a plurality of abrasions 140 that are perceptible by touch. Accordingly, textured surface 132 is rough. In particular, textured surface 132 has an average surface variation in a range of about 1.27 micrometers Ra (50 microinches Ra) to about 178 micrometers Ra (7000 microinches Ra) throughout a contact area of blade 130. For example, textured surface 132 has a minimum contact area of about 0.03 square millimeters (0.00005 square inches) and is configured to contact cables 110 (shown in FIG. 1) throughout the contact area. In some embodiments, abrasions 140 are formed by at least one of a mechanical abrasion process and a chemical abrasion process. In the exemplary embodiment, abrasions 140 are irregular and randomly dispersed throughout textured surface 132 due at least in part to the abrasion process. In alternative embodiments, textured surface 132 includes any feature that enables blade 130 to operate as described herein. For example, in some embodiments, textured surface 132 includes features such as ridges or ribs that form a raised pattern such as a knurled pattern, a diamond pattern, and/or any other suitable pattern. In further embodiments, textured surface 132 includes features such as knobs, spikes, and hooks that are disposed throughout textured surface 132 in any manner that enables blade 130 to operate as described herein. In some embodiments, features of textured surface 132 are formed using an additive process.

In some embodiments, blade 130 is retrofitted to an existing BOP system. Textured surface 132 facilitates compatibility of blade 130 with existing systems because textured surface 132 does not necessarily require changes in the shape and size of blade 130. In further embodiments, a blade of an existing BOP system is textured to include textured surface 132.

In reference to FIG. 3, in the exemplary embodiment, upper carrier 114 and lower carrier 118 define a gap 142 therebetween. In some embodiments, gap 142 is in a range of about 0.025 millimeters (mm) (0.001 inches (in.)) to about 0.500 mm (0.020 in.). Gap 142 facilitates upper blade 116 and lower blade 120 cutting objects. In some embodiments, upper blade 116 and lower blade 120 include textured surfaces 132 on opposite sides of gap 142 such that gap 142 is defined between textured surfaces 132. Accordingly, textured surfaces 132 increase the localized forces on objects, such as cables 110 (shown in FIG. 1) extending through gap 142. In alternative embodiments, blind shear ram 102 includes any gap that enables blind shear ram 102 to operate as described herein.

Figure 5:
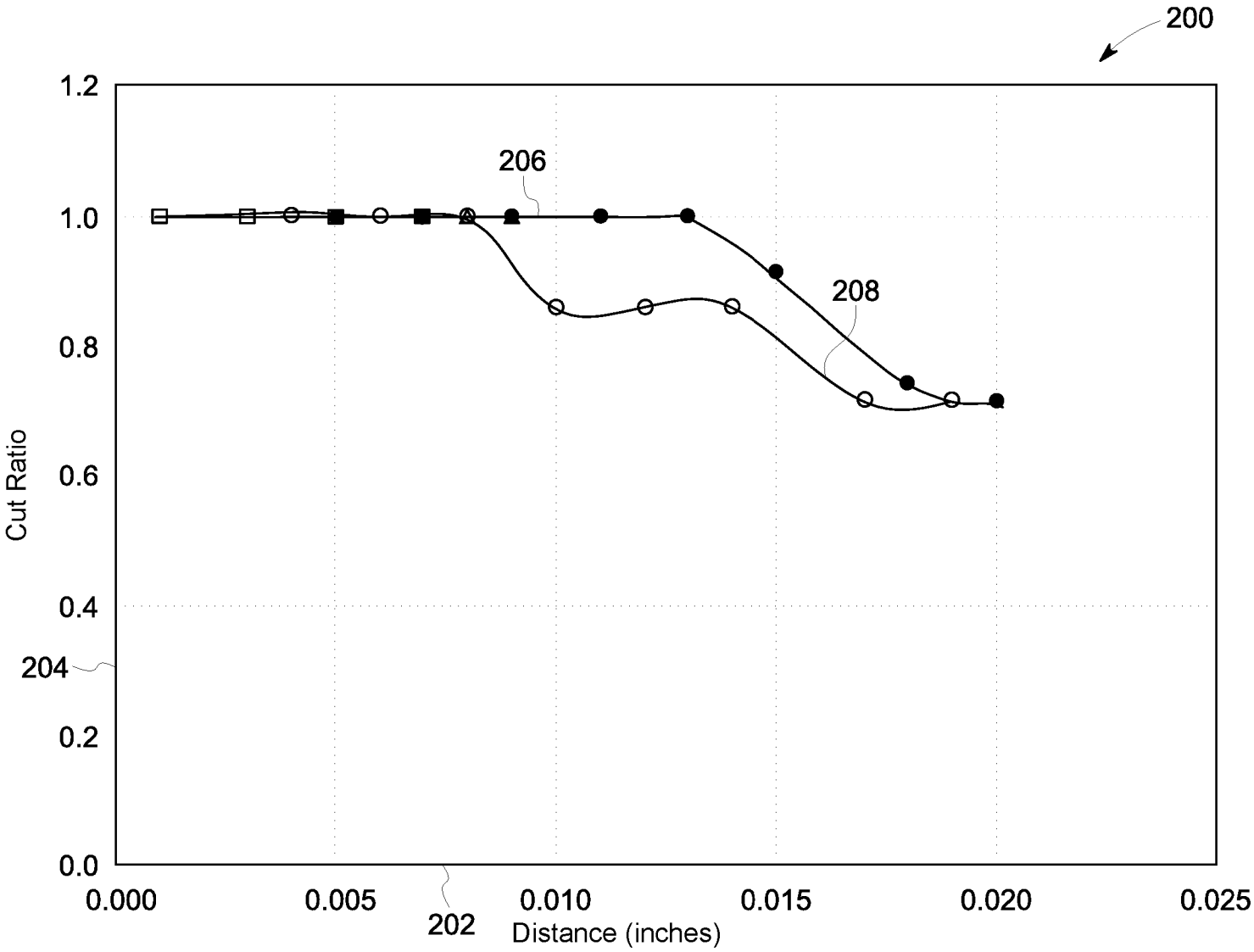
FIG. 5 is an exemplary graphical representation of cut ratio versus gap distance for blades.

FIG. 5 is an exemplary graphical representation of cut ratio versus gap distance for different blades. As used herein, the term "cut ratio" refers to the ratio of the cut portion of an object to the whole object. For example, a cut ratio of 1 indicates that an object has been completely severed into at least two distinct portions. A cut ratio of less than 1 indicates that an object has not been completely severed and remains connected as a single object. For example, the cut ratio relative to cable 110 compares the number of wires remaining intact to the number of wires that form cable 110. As such, the cut ratio is less than 1 if cable 110 is not completely severed and at least one wire forming cable 110 remains intact.

FIG. 5 includes a graph 200 including an X-axis 202 indicating a gap distance between blades (in.) from 0.000 to 0.025 in increments of 0.005 in. and a Y-axis 204 indicating cut ratio (unitless) from 0.0 to 1.0 in increments of 0.2. FIG. 3 further includes a curve 206 representing a blade including a textured surface. FIG. 3 also includes a curve 208 representing a blade including a smooth surface.

As shown on graph 200, curve 206 has a cut ratio of approximately 1.0 for gap distances in a range of about 0.000 in. to about 0.013 in. In contrast, curve 208 has a cut ratio of approximately 1.0 for gap distances in a range of about 0.000 in. to about 0.010 in. Curve 208 has a cut ratio less than 1.0 for gap distances greater than 0.010 in. Accordingly, curve 206 has higher cut ratios than curve 208 between about 0.010 in. and about 0.017 in. The higher cut ratios of curve 206 are at least partially due to the blade including a textured surface. In particular, the textured surface increases the stiction between a cable and the blade which increases local failure zones in the cable and causes the cable to fail as the blade is moved relative to the cable. As a result, blades including textured surfaces, represented by curve 206, provide an improved cutting performance in comparison to at least some known blades including smooth surfaces, represented by curve 208.

In reference to FIGS. 1 and 4, a method of assembling blind shear ram 102 includes providing blade 130 configured to cut cable 110 in wellbore 104. The method also includes texturing at least one surface of blade 130 to form textured surface 132. In some embodiments, material is removed from blade 130 using a mechanical abrasion process and/or a chemical abrasion process. For example, in some embodiments, textured surface 132 is formed by mechanically abrading a surface of blade 130 using a tool (not shown) in a mechanical abrasion process including, for example and without limitation, scraping, sanding, scratching, scuffing, and rubbing. In further embodiments, a chemical is applied to blade 130 in a chemical abrasion process including, for example and without limitation, blasting, spraying, and etching. In alternative embodiments, textured surface 132 is formed in any manner that enables BOP system 100 to operate as described herein.

In the exemplary embodiment, the method further includes coupling blade 130 to at least one of lower carrier 118 and upper carrier 114 such that textured surface 132 is configured to contact cables 110 when lower carrier 118 and upper carrier 114 are in the second position. In some embodiments, a surface of upper blade 116 is textured to form first textured surface 132 and a surface of lower blade 120 is textured to form second textured surface 132. Upper blade 116 is coupled to upper carrier 114 such that first textured surface 132 is configured to contact cables 110. Lower blade 120 is coupled to lower carrier 118 such that second textured surface 132 is configured to contact cables 110. In some embodiments, the method includes aligning lower carrier 118 and upper carrier 114 such that first textured surface 132 and second textured surface 132 define gap 142 therebetween when upper carrier 114 and lower carrier 118 are in the second position.

The above-described methods and systems facilitate cutting cables in a wellbore to provide a more complete seal of the wellbore. For example, embodiments of the blowout prevention (BOP) system include a blind shear ram including blades including at least one textured surface. In some embodiments, abrasions are formed in the textured surface using mechanical and/or chemical processes. In further embodiments, the textured surface includes a pattern. The textured surface grips the cables to facilitate the blades completely severing the cables. As a result, the cables are inhibited from extending across the seal when the blind shear ram seals the wellbore.

An exemplary technical effect of the methods, systems, and apparatus described herein includes at least one of: (a) increasing a cut ratio of shear rams in BOP systems; (b) increasing reliability of BOP systems; and (c) providing blades including textured surfaces that are compatible with existing BOP systems.

Exemplary embodiments of BOP methods, systems, and apparatus are not limited to the specific embodiments described herein, but rather, components of systems and/or steps of the methods may be utilized independently and separately from other components and/or steps described herein. For example, the methods may also be used in combination with other systems requiring shear rams, and are not limited to practice with only the systems and methods as described herein. Rather, the exemplary embodiment can be implemented and utilized in connection with many other applications, equipment, and systems that may benefit from increased cutting efficiency.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blind shear ram for a blowout prevention system, said blind shear ram comprising:

a casing configured to couple to a stack and receive at least one pipe and at least one cable, the at least one pipe and the at least one cable extending through a wellbore defined by the stack;

an upper carrier comprising an upper blade; and a lower carrier comprising a lower blade, at least one of said upper carrier and said lower carrier configured to move relative to said casing such that said upper carrier and said lower carrier are positionable in a first position in which said upper carrier and said lower carrier are spaced apart and a second position in which said upper carrier and said lower carrier seal the wellbore, said upper blade and said lower blade configured to cut the at least one pipe and the at least one cable when said upper carrier and said lower carrier move between the first position and the second position, wherein at least one of said upper blade and said lower blade comprises a cutting edge abutting a top surface of said upper blade or said lower blade, a rear edge abutting a bottom surface of said upper blade or said lower blade and being opposite the cutting edge, and a textured surface extending from the cutting edge to the rear edge and configured to induce friction between the at least one cable and said at least one of said upper blade and said lower blade.

2. The blind shear ram in accordance with claim 1, wherein said textured surface has a surface variation in a range of about 1.27 micrometers Ra (50 microinches Ra) to about 178 micrometers Ra (7000 microinches Ra).

3. The blind shear ram in accordance with claim 1, wherein said upper blade comprises said textured surface, the cutting edge and the rear edge opposite said cutting edge.

4. The blind shear ram in accordance with claim 3, wherein said textured surface is a first textured surface, said upper blade further comprising a second textured surface.

5. The blind shear ram in accordance with claim 1, wherein said textured surface is a first textured surface, said lower blade comprising a second textured surface, a lower blade cutting edge, and a lower blade rear edge opposite said cutting edge, said textured surface extending from said lower blade cutting edge to said lower blade rear edge.

6. The blind shear ram in accordance with claim 5, wherein said first textured surface is opposite said second textured surface such that said first textured surface and said second textured surface define a gap therebetween when said upper carrier and said lower carrier are in the second position.

7. The blind shear ram in accordance with claim 1, wherein said textured surface comprises abrasions produced by at least one of a mechanical abrasion process and a chemical abrasion process.

8. The blind shear ram in accordance with claim 1, wherein said textured surface comprises a plurality of raised features.

9. The blind shear ram in accordance with claim 1, wherein said plurality of raised features form a raised pattern.

10. A blowout prevention system comprising:

a stack defining a wellbore; and a blind shear ram configured to couple to said stack and receive at least one pipe and at least one cable extending through the wellbore, said blind shear ram comprising:

an upper carrier comprising an upper blade; and a lower carrier comprising a lower blade, at least one of said upper carrier and said lower carrier configured to move relative to said stack such that said upper carrier and said lower carrier are positionable in a first position in which said upper carrier and said lower carrier are spaced apart and a second position in which said upper carrier and said lower carrier seal the wellbore, said upper blade and said lower blade configured to cut the at least one pipe and the at least one cable when said upper carrier and said lower carrier move between the first position and the second position, wherein at least one of said upper blade and said lower blade comprises a cutting edge abutting a top surface of said upper blade or said lower blade, a rear edge abutting a bottom surface of said upper blade or said lower blade and being opposite the cutting edge and a textured surface extending from the cutting edge to the rear edge and configured to induce friction between the at least one cable and said at least one of said upper blade and said lower blade.

11. The blowout prevention system in accordance with claim 10, wherein said textured surface has a surface variation in a range of about 1.27 micrometers Ra (50 microinches Ra) to about 178 micrometers Ra (7000 microinches Ra).

12. The blowout prevention system in accordance with claim 10, wherein said upper blade comprises said textured surface, the cutting edge and the rear edge opposite said cutting edge.

13. A method of assembling a blind shear ram for a blowout prevention system, said method comprising:

providing at least one blade configured to cut a cable in a wellbore, wherein the at least one blade includes a cutting edge abutting a top surface of said upper blade or said lower blade, a rear edge abutting a bottom surface of said upper blade or said lower blade and being opposite the cutting edge, and at least one surface extending from the rear edge to the cutting edge;

texturing the at least one surface of the at least one blade to form at least one textured surface, wherein the at least one textured surface is configured to induce friction between the cable and the at least one blade; and coupling the at least one blade to at least one of a lower carrier and an upper carrier such that the at least one textured surface is configured to contact the cable, at least one of the upper carrier and the lower carrier configured to move relative to the casing such that the upper carrier and the lower carrier are positionable in a first position in which the upper carrier and the lower carrier are spaced apart and a second position in which the upper carrier and the lower carrier seal the wellbore.

14. The method in accordance with claim 13, wherein texturing the at least one surface of the at least one blade to form at least one textured surface comprises applying a chemical to the at least one surface of the at least one blade.

15. The method in accordance with claim 13, wherein texturing the at least one surface of the at least one blade to form at least one textured surface comprises abrading, using a tool, the at least one surface of the at least one blade.

16. The method in accordance with claim 13, wherein texturing the at least one surface of the at least one blade to form at least one textured surface comprises texturing a first surface and a second surface to form a first textured surface and a second textured surface.

17. The method in accordance with claim 16, wherein the at least one blade includes an upper blade and a lower blade, and wherein coupling the at least one blade to at least one of a lower carrier and an upper carrier comprises coupling the upper blade to the upper carrier and coupling the lower blade to the lower carrier.

18. The method in accordance with claim 17, wherein the upper blade includes the first textured surface and the lower blade includes the second textured surface, the method further comprising aligning the lower carrier and the upper carrier such that the first textured surface and the second textured surface define a gap therebetween when the upper carrier and the lower carrier are in the second position.

19. The method in accordance with claim 13, wherein texturing the at least one surface of the at least one blade to form at least one textured surface comprises forming a raised pattern on the at least one textured surface.

20. The method in accordance with claim 13, wherein texturing the at least one surface of the at least one blade to form at least one textured surface comprises forming a plurality of abrasions.

* * * * *